US008488415B2

(12) United States Patent
Graber

(10) Patent No.: US 8,488,415 B2
(45) Date of Patent: Jul. 16, 2013

(54) SUBMERSIBLE ELECTRO-DYNAMIC ACOUSTIC PROJECTOR

(76) Inventor: Curtis E. Graber, Woodburn, IN (US)

( * ) Notice: Subject to any disclaimer, the term of this patent is extended or adjusted under 35 U.S.C. 154(b) by 467 days.

(21) Appl. No.: 12/807,015

(22) Filed: Aug. 26, 2010

(65) Prior Publication Data

US 2012/0051188 A1 Mar. 1, 2012

(51) Int. Cl.
*G10K 9/12* (2006.01)

(52) U.S. Cl.
USPC ..... 367/172

(58) Field of Classification Search
CPC ..... G01S 1/72; G10K 9/12
USPC ..... 367/185, 175, 172, 167
See application file for complete search history.

(56) References Cited

U.S. PATENT DOCUMENTS

| | | | | |
|---|---|---|---|---|
| 782,312 | A | 2/1905 | Zehden | |
| 1,640,538 | A | 8/1927 | DuBois-Reymond | |
| 2,977,573 | A | 12/1952 | Mott | |
| 2,978,669 | A | 4/1961 | Harris | |
| 3,118,125 | A | 1/1964 | Sims | |
| 3,643,117 | A | 2/1972 | Alger et al. | |
| 3,760,346 | A | 9/1973 | Kieser et al. | |
| 4,306,121 | A * | 12/1981 | Joscelyn et al. | 381/395 |
| 4,466,083 | A | 8/1984 | Willard et al. | |
| 4,763,307 | A | 8/1988 | Massa | |
| 4,868,799 | A | 9/1989 | Massa | |
| 5,345,206 | A | 9/1994 | Morcos | |
| 8,218,398 | B2 * | 7/2012 | Graber | 367/133 |
| 8,223,592 | B2 * | 7/2012 | Graber | 367/153 |
| 2008/0056527 | A1 * | 3/2008 | Adamson | 381/409 |
| 2009/0269224 | A1 | 10/2009 | Hunt et al. | |
| 2010/0119090 | A1 * | 5/2010 | Graber | 381/190 |
| 2011/0305117 | A1 * | 12/2011 | Graber | 367/153 |
| 2012/0051188 | A1 * | 3/2012 | Graber | 367/175 |

OTHER PUBLICATIONS

Search Report and Written Opinion of International Search Authority.

* cited by examiner

*Primary Examiner* — Daniel Pihulic
(74) *Attorney, Agent, or Firm* — Paul W. O'Malley; Susan L. Firestone

(57) ABSTRACT

An electro-dynamic acoustic projector provides a rigid enclosure having an open end. A pressure compensated chamber extends into the rigid enclosure from the open end. A vibratile piston is located in the open end of the rigid enclosure and closed the pressure compensated chamber. The vibratile piston has an axis of oscillation perpendicular to the plane of the open end and an anterior major surface exposed from the open end for generating sound waves in water. A magnet assembly is attached to the vibratile piston which interacts with a stator coil positioned with respect the rigid enclosure and vibratile piston. The magnet assembly is affixed to a posterior surface of the vibratile piston. The magnet assembly comprises first and second permanent magnets located with respect to one another to bring like poles into facing opposition. The facing like poles are separated from one another by a ferromagnetic focus element.

11 Claims, 9 Drawing Sheets

SUBMERSIBLE ELECTRO-DYNAMIC ACOUSTIC PROJECTOR

BACKGROUND

1. Technical Field

The technical field relates generally to electroacoustic transducers and more particularly to an electro-dynamic projector capable of absorbing high power inputs for generating substantial underwater acoustic energy over a broad frequency range at a varying depths.

2. Description of the Problem

The predominant types of electroacoustic projectors/transducers in contemporary use for generating sound for propagation through water are: piezoelectric; magnetostriction; hydraulic acoustic; and electro-dynamic. Piezoelectric transducers are particularly common due to their simplicity, electrical efficiency and low distortion within their operative band width. However, piezoelectric devices are characterized by narrow resonance peaks, phase shift issues and poor damping of ring down. While the relatively high voltages and low currents at which piezoelectric devices operate contribute to their high efficiency, high voltage operation can be an issue in salt water environments due to the relatively high electrical conductivity of salt water.

Massa, in U.S. Pat. No. 4,763,307 taught underwater electro-dynamic transducers based on moving coil and moving iron principals. These transducers were combined with a variable pressure, gas filled back chamber for housing the transducer electrical circuit. The variable pressure back chamber balanced pressure in the back chamber, and behind the piston, with external ambient pressure. Pressure variation was achieved by providing a bladder which collapsed with increases in ambient pressure. The bladder communicated with the space behind the piston/diaphragm through a breather tube. This should prevent the bladder volume from functioning as a (variable frequency) tuned chamber for the diaphragm.

Moving coil and moving iron devices operate at lower voltages than piezoelectric devices which reduces electrical issues with operating in a salt water environment. However, low voltage operation entails the use of high currents. High current flow through the transducer voice coil to produce a high acoustic power output results in the generation of substantial amounts of heat from resistive losses in the system's voice coil. Massa recognized a need to sink heat from the voice coil for the moving coil design and employed heat conducting metal strips between the piston mounted voice coil and the transducer piston to transfer heat to the exposed face of the piston.

Most contemporary electro-dynamic transducers for both air and water applications use a moving coil design. In a moving coil transducer a stationary permanent magnet is positioned close to a speaker diaphragm. An electrical current carrying voice coil is glued to the diaphragm. Upon application of an alternating electric current to the coil the coil is attracted or repelled from the magnet with the changes in phase of the current. Since the diaphragm to which the coil is attached can move acoustic waves may be induced in a transmission medium, such as air or water, from diaphragm. Moving iron loudspeakers place an iron or a similar ferro-magnetic material on the speaker diaphragm and provide a stationary voice coil. Moving iron loudspeakers were common in the 1920's, but were gradually displaced for most applications in order to reduce diaphragm mass.

SUMMARY

An electroacoustic transducer, usually employed as an underwater acoustic radiation projector, comprises a rigid enclosure having an open end. A vibratile piston/moving member is located on the rigid enclosure to define an axis of oscillation for the vibratile piston and to position the vibratile piston at the open end of the rigid enclosure to expose a major anterior surface of the vibritile piston to the environment. A major posterior side of the vibratile piston faces a pressure balanced gas filled cavity. The internal pressure of the cavity is typically compensated for changes in ambient pressure, usually by providing a compressible section which allows for changes in volume of the cavity with changes in ambient pressure.

The vibratile piston provides the moving member for a linear reciprocating electric motor (linear actuator) which operates as an acoustic transducer. The vibratile piston supports a magnet assembly which extends from the posterior major surface of the vibratile piston. The magnet assembly comprises at least first and second magnets which have their poles axially aligned on one another and with the axis of oscillation of the vibratile piston. The first and second magnets are positioned with like poles in facing opposition. A ferromagnetic focusing piece is positioned between the facing like poles of the first and second magnets. The focusing piece is bonded to the first and second magnets.

The linear reciprocating electric motor includes a stator which supports a stator/voice coil. The magnet assembly is cylindrical and extends into a cylindrical gap or recess in a stator. A stator coil is supported by the stator adjacent to and just outside of the gap.

The vibratile piston includes a thermally conductive section in communication with the variable interior volume of the watertight envelope and with the environment to function as a heat sink from the interior.

DETAILED DESCRIPTION

Figure 1:
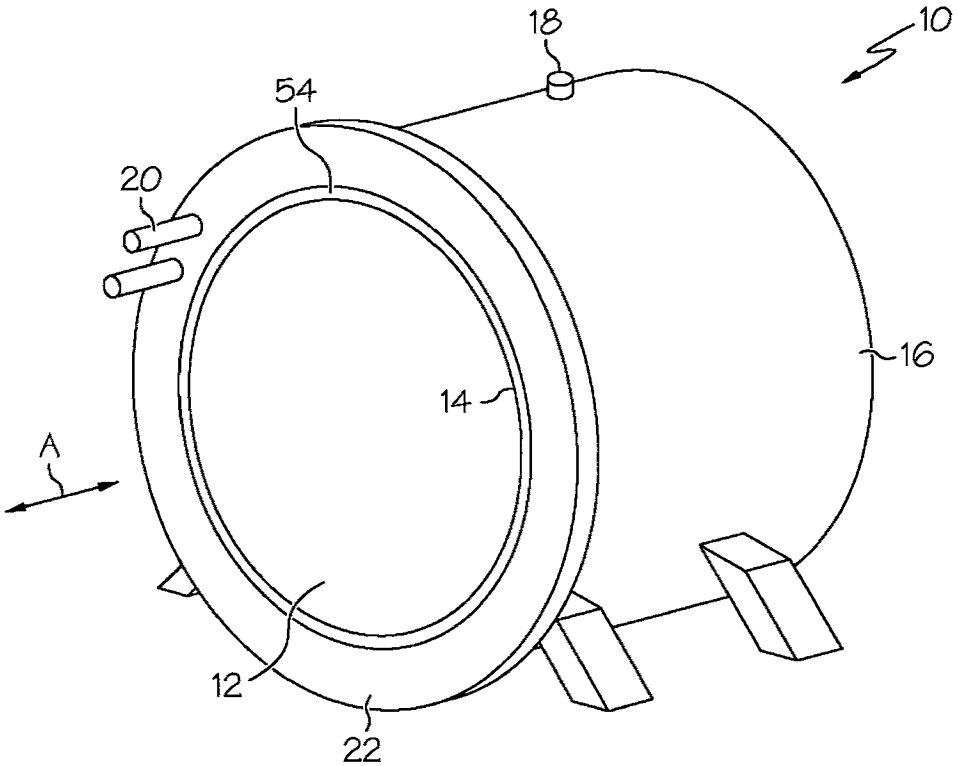
FIG. 1 is a perspective view of an underwater electro-dynamic acoustic transducer.

In the following detailed description, like reference numerals and characters may be used to designate identical, corresponding, or similar components in differing drawing figures. Furthermore, example sizes/models/values/ranges may be given with respect to specific embodiments but are not to be considered generally limiting.

Referring to FIG. 1, an electro-dynamic acoustic transducer assembly 10 is illustrated from a front perspective, showing an anterior transducer face 12 exposed from an open end 14 of a rigid housing/enclosure 16 and held by a gasket ring 54 centered in a rim 22. Where intended for underwater use the rigid housing 16 and anterior transducer face 12 should be made of corrosion resistant material or covered with an anti-corrosive protective layer. Anterior transducer face 12 oscillates along axis A which is perpendicular to and centered on the anterior transducer face 12. The interior of rigid housing 16 is vented to the environment and a check valve 18 may be accessed to pre-pressure a closed, variable volume, back chamber located inside the rigid housing (See FIGS. 2 and 3). Electrical connectors 20 are shown located on rim 22 of rigid housing 16, but their location on the housing is discretionary. In one form rigid housing 16 is 19.25 inches long and has a diameter of 17.38 inches. The weight of the transducer assembly 10 is about 46 lbs. Its maximum root mean square power capacity is 2.5 kW and its peak power output 4 kW. The intended frequency range is 5 to 250 Hz. However, the transducer system described here could be manufactured to produce sound efficiently up to the limit of the mass/frequency ratio in the moving system. The upper frequency limit may be pushed into the area of 10 KHz or even somewhat higher.

Figure 2:
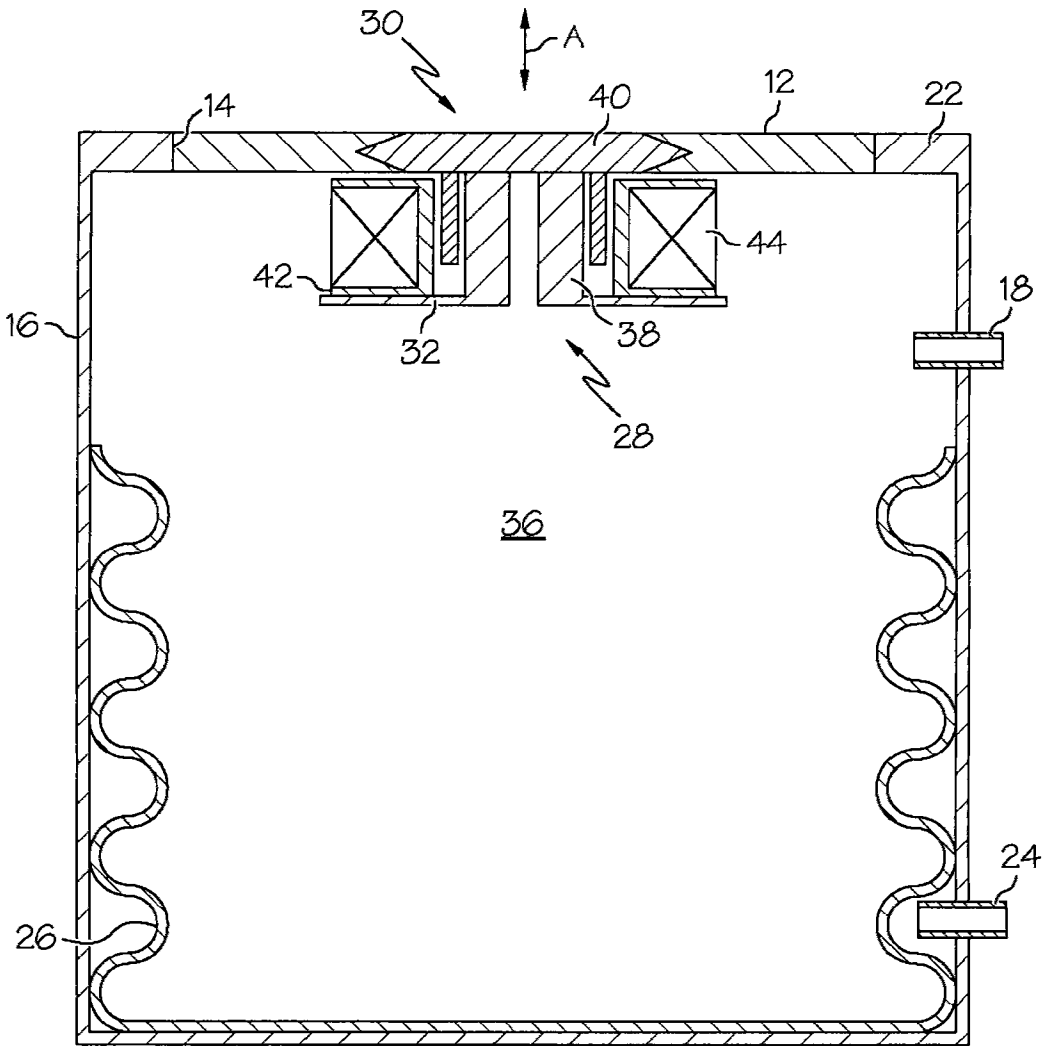
FIG. 2 is a cross sectional view of the underwater electro-dynamic acoustic transducer taken along the longitudinal axis side of the enclosure of *Fig.* 1.
Figure 3:
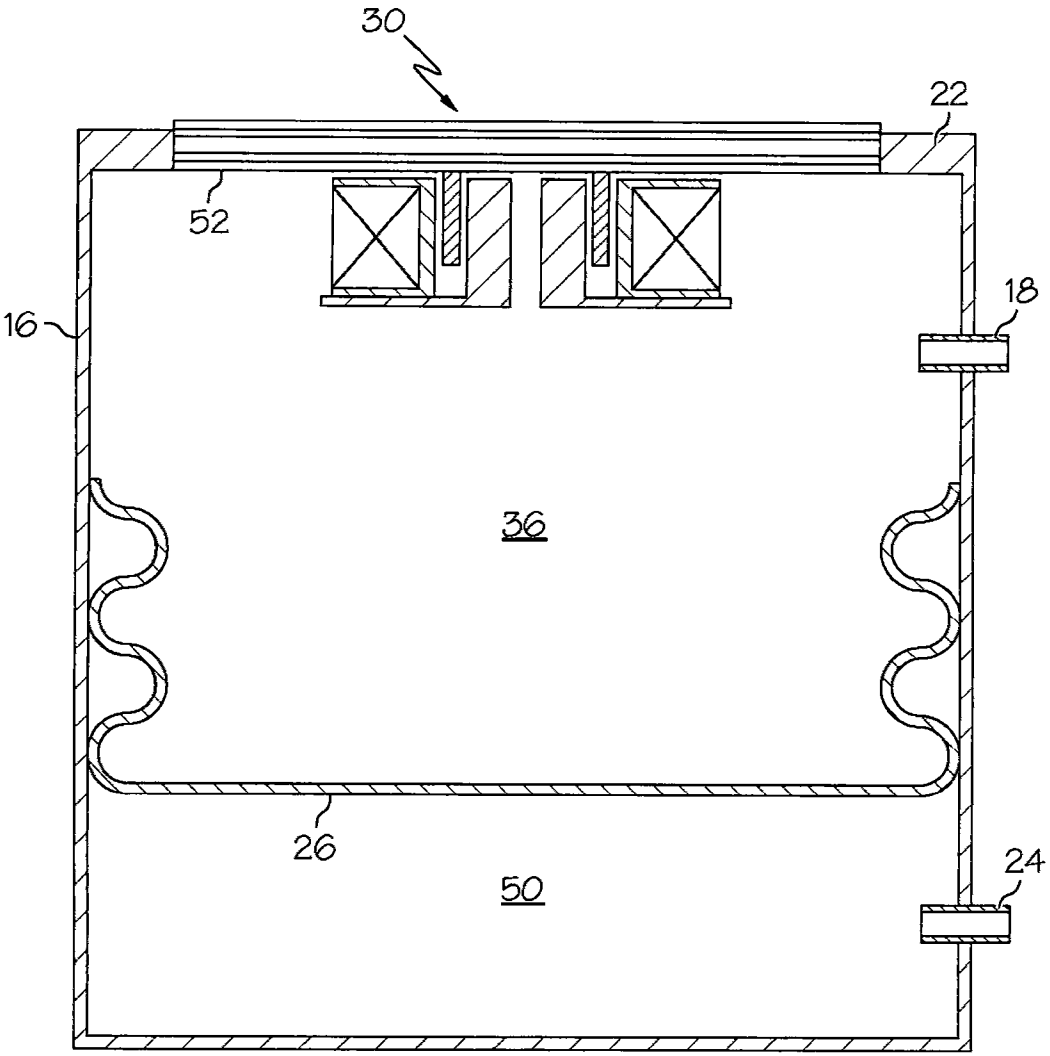
FIG. 3 is a cross sectional view of the underwater electro-dynamic acoustic transducer illustrating compression of internal pressure compensating mechanism.
Figure 4A:
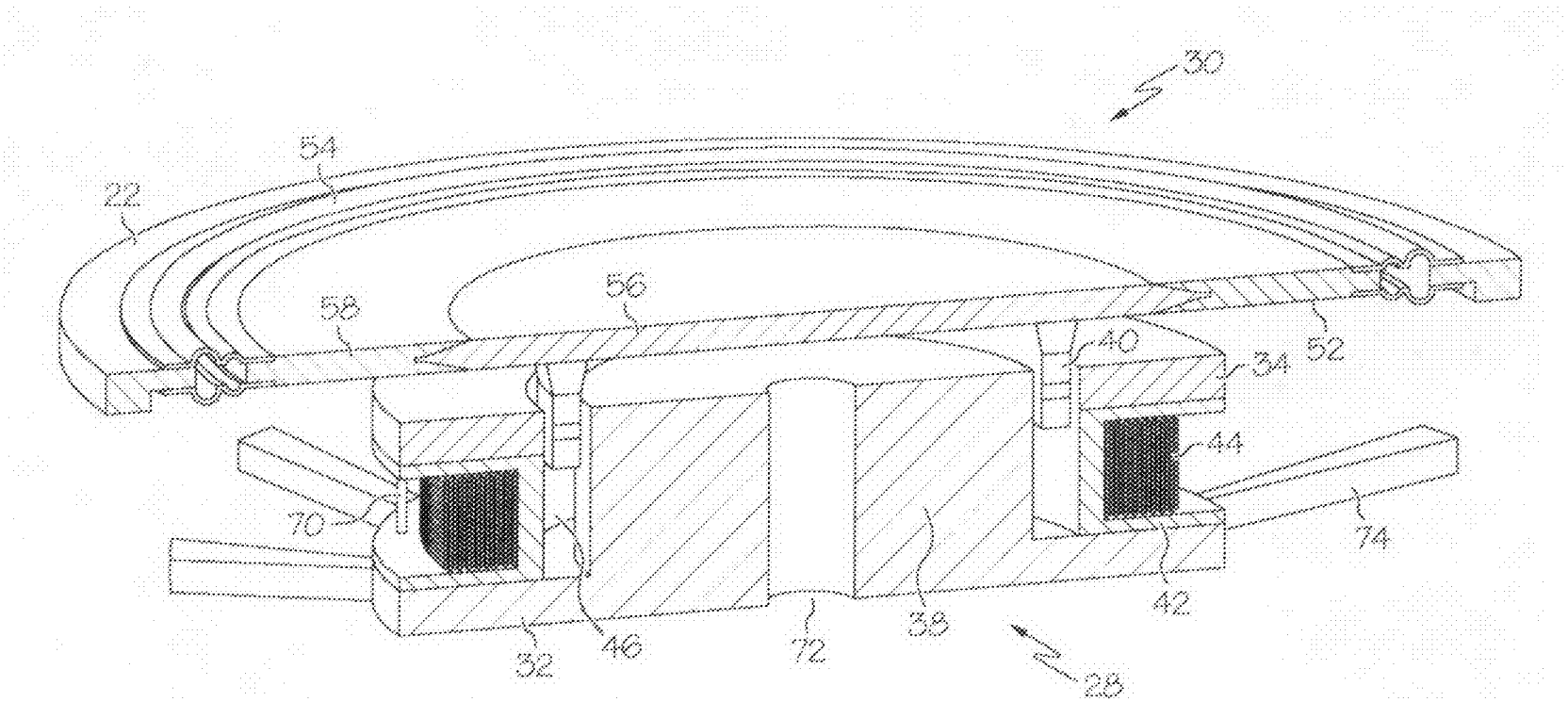
FIGS. 4A and B are cutaway views of the vibratile piston/moving member and stator assembly including a detail view of a magnet assembly forming part of the moving member.
Figure 4B:
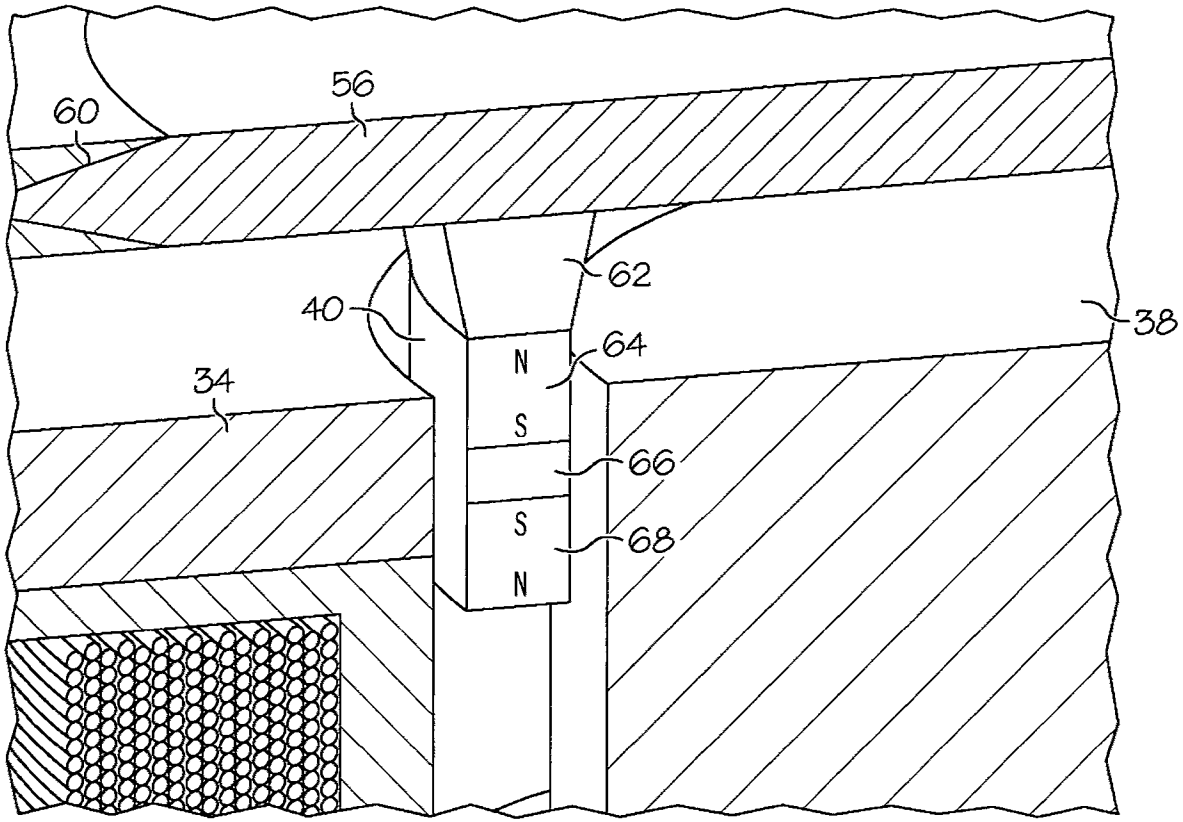

Referring to FIGS. 2 and 3, the electro-dynamic acoustic transducer assembly 10 is shown in cross section. FIGS. 2 and 3 illustrate the relation of a vibratile piston 30 to the closed, variable volume backchamber 36. Vibratile piston 30 is positioned within the open end 14 to rigid housing 16 defined by rim 22. Vibratile piston 30 has a limited travel in the directions indicated by double arrow "A" (axis of oscillation) into and out of the rigid housing 16 and closes the open end 14 of the housing.

Mounted within the interior of rigid housing 16 is a flexible wall 26 which divides the interior of rigid housing 16 into two parts, one (backchamber 36) watertight and the other (vented section 50) exposed to ambient pressure through vent 24. Flexible wall 26 is distended or displaced with increasing pressure in vented section 50 until air pressure in back chamber 36 balances with ambient pressure. In this way vibratile piston 30 closes one end of back chamber 36 and is exposed along its posterior major surface 52 to back chamber 36. Pressure balancing assures that the vibratile piston 30 is not displaced from its neutral position with changes in depth (or analogous changes in ambient pressure in an atmospheric system) so there is no change in system compliance with changes in ambient pressure. Back chamber 36 also provides a 'tuned' chamber for vibratile piston 30. The frequency to which the back chamber 36 is 'tuned' can be allowed to change with changes in ambient pressure or the back chamber 36 can be prepressurized (temporarily displacing vibratile piston 30 from its neutral position, through additions (or release) of gas through check valve 18. Prepressurization of back chamber 36 allows selection of the volume of the back chamber 36 location of the transducer assembly 10 at a location with a known ambient pressure, for example by submergence, and thus the resonant frequency can be selected within the limits of size of the back chamber 36. Careful selection of this frequency should account for changes in the speed of sound at higher air/gas densities and pressures. This allows tuneability of the transducer mechanical QMS (mechanical damping) of the transducer system.

Attached to and extending outwardly from posterior major surface 52 of vibratile piston 30 is a magnet assembly 40. Magnet assembly 40 extends into a gap 46 formed within a stator 28. Gap 46 is defined by an interior central pole 38 of a back plate 32, forming one side of the gap 46, and a spool 42 and front plate 34 which form a facing side of the gap 46. Stator 28 comprises the spool 42, a stator coil 44 located on the spool 42, the back plate 32 and the front plate 34. Spool 42 may be held between the front plate 34 and the back plate 32 by suitable bolts 70, adhesives or other conventional methods. Bolts 70 made of ferromagnetic material would be useful from the stand point of closing gaps in the stator magnetic circuit.

Vibratile piston 30, with its magnet assembly 40 and the associated stator 38, are Illustrated in greater detail as seen with reference to F*igs*. 4A and 4B. Vibratile piston 28 Is shaped as a disk suspended along its edge from a cylindrical rim 22 by a flexible gasket seal 54. Gasket seal 54 is flexible, comprises anterior and posterior sections and functions as a flexible rubber alignment spider to ensure that vibratile piston 30, or more particularly the magnet assembly 40 extending from the vibratile piston, tracks linearly in stator gap 46. A void may be present between the outer diameter of vibratile piston 30, rim 22 and the anterior and posterior sections of the gasket seal 54, which may be filled with a heat conducting oil. Vibratile piston 38 comprises three sections, an inner disk 56 which is generally made of a heat conducting aluminum alloy, an outer disk 58 surrounding the inner disk, the outer disk 58 being made of a carbon composite material and the magnet assembly 40. By having the disk like portion of vibratile piston 30 being formed in a two element construction heat sink capacity is maintained with reduced mass over a construction where the entire disk was metal. Outer disk 58 is fabricated on inner disk 56 along a double bevel joint 60. The magnet assembly 40 extends outwardly from the posterior major surface 52.

The magnet assembly 40 extends outwardly from the posterior major surface 52 and is generally cylindrical. This shape accommodates the ring shape in which neodymium magnets are commonly supplied. (Alternative materials may be employed in the magnets, such as samarium cobalt). The magnet assembly 40 has four layers, a base layer 62 bonded to the inner disk 56. A forward or first ring magnet 64 bonded to the base layer 62. A ferromagnetic focus ring 66 (typically soft iron) bonded to the forward ring magnet 64. A second or rearward ring magnet 68 bonded to the ferromagnetic focus ring 66. The forward and rearward ring magnets 64, 68 are oriented to bring like poles into facing opposition through the ferromagnetic focus ring 66. Focus ring 66 is typically made of a soft iron material, and functions to focus the magnetic flux of the permanent magnets for increased performance and reduced distortion. Magnet assembly 40 can be analogized to the moving member of a linear reciprocating electric motor or linear actuator.

Stator 28 includes a spool 42 which supports and positions a stator coil 44. Spool 42 (typically nylon) is located between front plate 34 and back plate 32 and may be held in this position by bolts 70. Back plate 32 includes a hollow central pole 38 which extends forward (i.e. toward the vibratile piston 30) from the back plate inside the interior diameter of the spool 42. Central pole 38 includes a central opening 72 which allows free passage of air between the central portion of the posterior surface 52 and the back chamber 36. Front plate 32 and back plate 34 are fabricated from ferromagnetic material and may be constructed as a plurality of laminations to suppress the generation of eddy currents when the device is in use. Stator 28 is supported from interior walls of rigid housing 16 by plurality of struts 74. In the figure struts 74 are illustrated as extending between the back plate 32 and the interior wall of the rigid housing 16. Additional struts (not shown) may be used between the front plate 34 and the interior wall of the rigid housing 16. Struts 74 should be thermally conductive to transfer heat from stator coil 44 through the front and back plates 34, 32 to rigid housing 16 which allows heat to be sunk to surrounding water from the housing.

Figure 5:
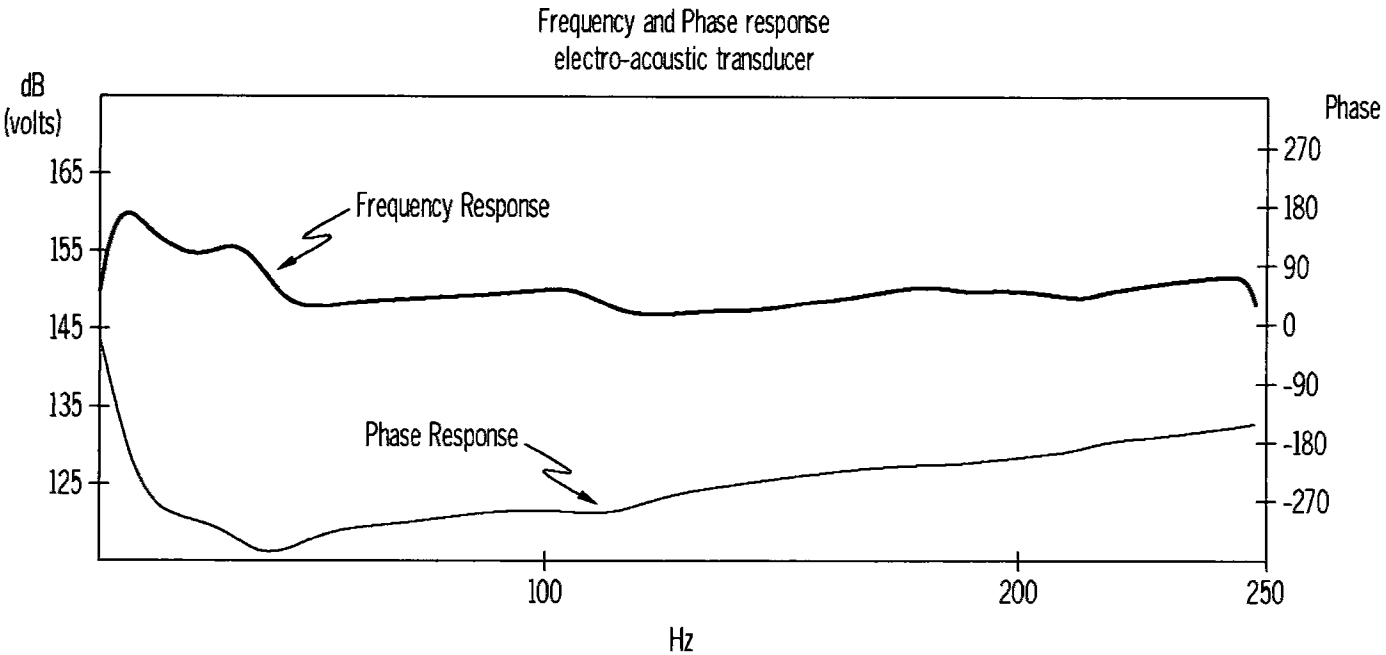
FIGS. 5, 6A, 6B, 7, 8, 9 and 10 are graphs comparing operation of the present electro-dynamic acoustic transducer compared with a piezoelectric system.
Figure 6A:
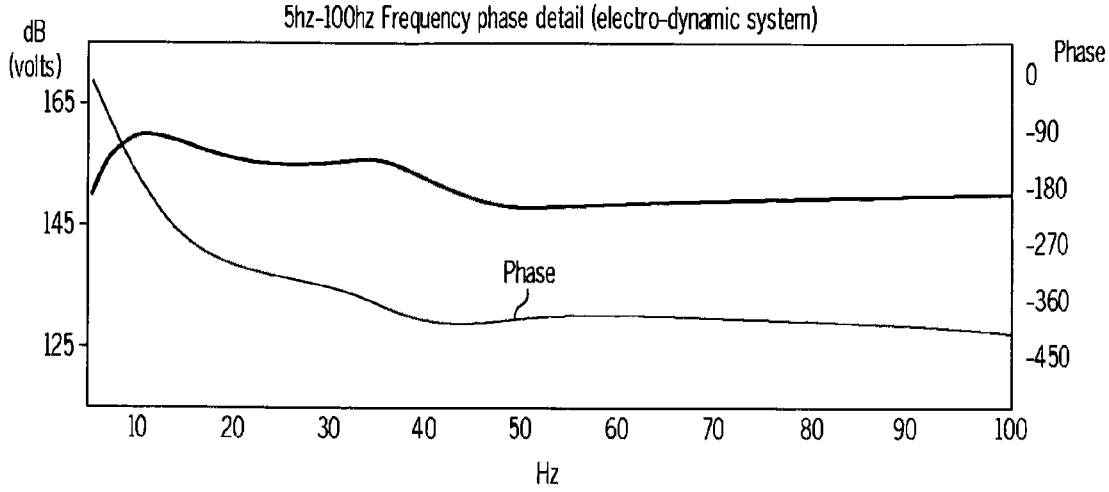
Figure 6B:
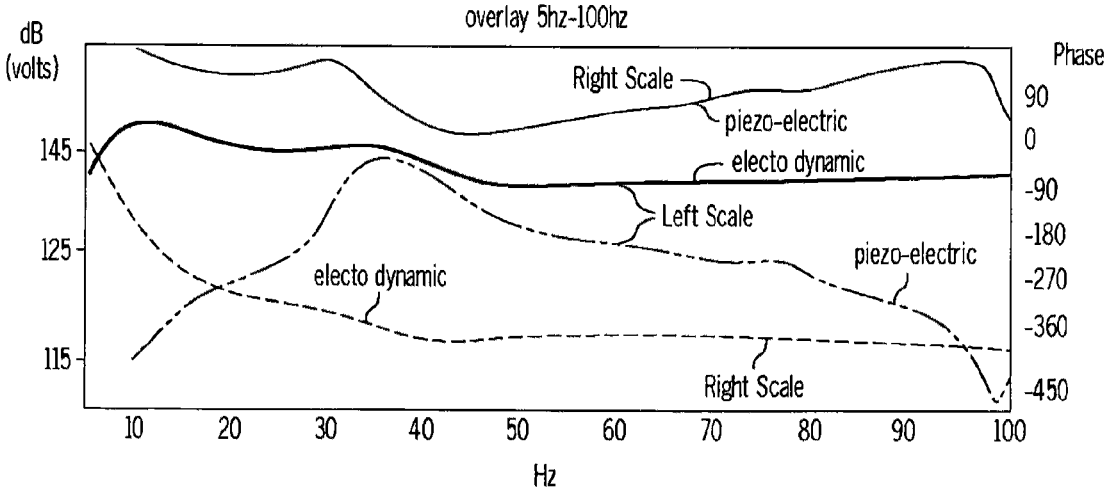

Performance of an electro-dynamic acoustic transducer 10 is shown in a series of graphs marked FIGS. 5 through 10 including comparisons with a low frequency piezoelectric device for underwater application. FIG. 5 illustrates output and phase against frequency. Output intensity levels are highly stable from 5 to 250 Hz though phase shift varies from near 0 to over −270 degrees. FIGS. 6A and 6B may be used to compare response curves for the present electro-dynamic device against the piezoelectric system (FIG. 6B) over the 5 to 100 Hz range. FIG. 6B highlights a narrow resonant peak for a piezoelectric device around 40 Hz. In comparison the present electro-dynamic system is relatively linear. It is common to have a significant phase shift in the exact center of the bell curve of its usable frequency range in a resonant piezoelectric system where a non-resonant device (such as an electro-dynamic system) typically exhibits a highly linear phase shift over a broad portion of the usable frequency range. Phase shift for an electro-dynamic device is more significant at the lowest portion of its usable frequency range at high output due to the high mass of the vibratile piston.

Figure 7:
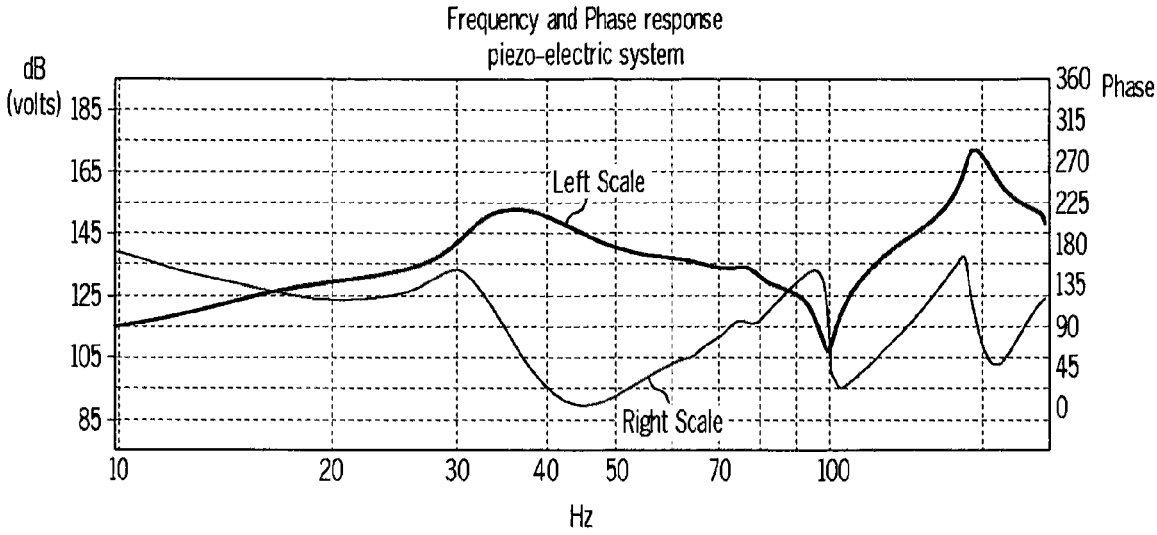
Figure 8:
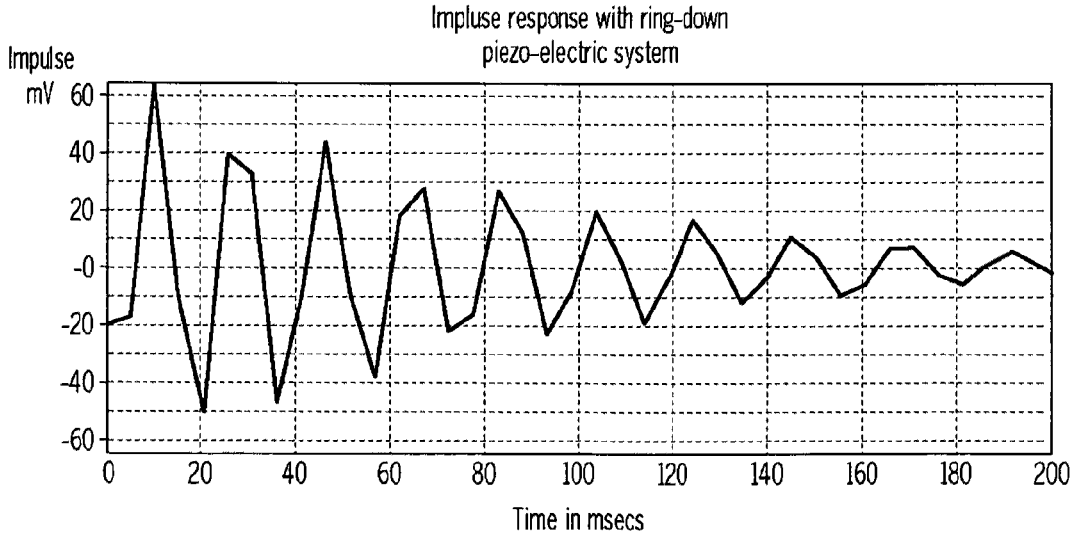
Figure 9:
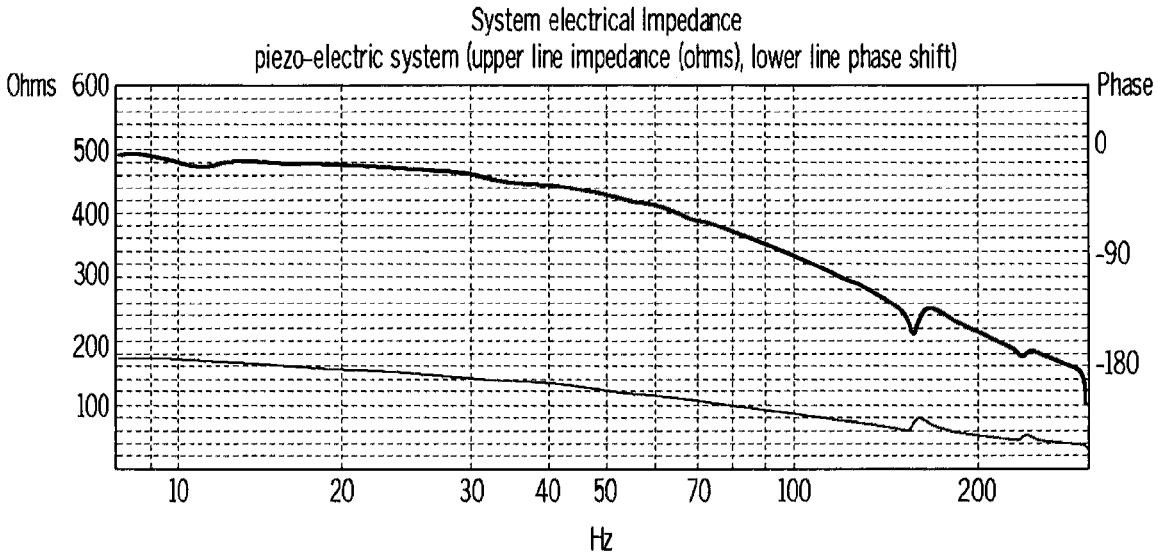
Figure 10:
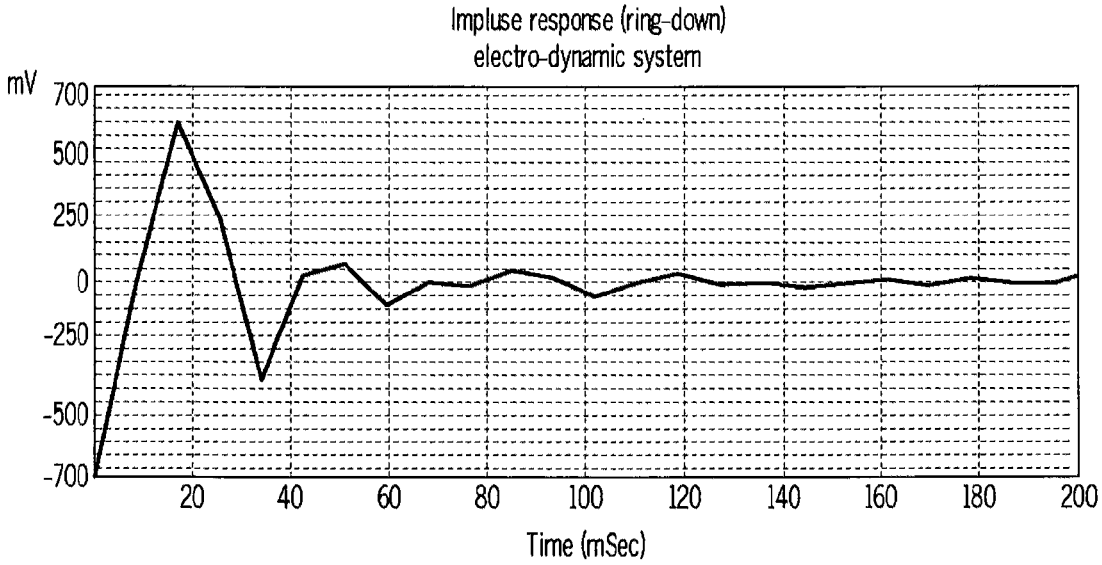

FIG. 7 illustrates output and phase response against frequency for a piezoelectric device. FIG. 8 illustrates ring down times for a piezoelectric device. In FIG. 9 shows the impedance of a piezoelectric device. In comparison the impedance of the present electro-dynamic device is much lower and nearly purely resistive. Electrically the electro-dynamic device is easier to drive with an amplifier due to its near linear response with changes in frequency. FIG. 10 illustrates ring down time in milliseconds from an impulse applied to the current electro-dynamic system.

What is claimed is:

1. An electro-dynamic acoustic transducer system comprising:

a rigid enclosure having an open end;

a pressure compensated chamber extending into the rigid enclosure from the open end;

a vibratile piston located in the open end of the rigid enclosure to have an axis of oscillation perpendicular to the plane of the open end;

the vibratile piston being located in the open end to close the pressure compensated chamber;

the vibratile piston having an anterior major surface exposed from the open end;

a magnet assembly attached to the vibratile piston;

a stator coil positioned with respect the rigid enclosure to interact with the magnet structure upon application of an electrical signal to the stator coilfor generating forces to move the vibratile piston;

the pressure compensated chamber being responsive to changes in ambient pressure by changes in volume for balancing its internal pressure with ambient pressure;

the pressure compensated chamber providing a tuned backchamber for the vibratile piston; and a valve allowing adjustment of the internal pressure of the pressure compensated chamber to determine the volume of the pressure compensated chamber at known ambient pressures.

2. An electro-dynamic acoustic transducer system as claimed in claim 1, further comprising:

the magnet assembly being affixed a posterior surface of the vibratile piston; and a stator supported from the rigid housing in the pressure compensated chamber, the stator locating the stator coil with respect to the magnet assembly and the stator providing magnetic circuit elements cooperating with the stator coil.

3. An electro-dynamic acoustic transducer system as claimed in 2, further comprising:

the vibratile piston including a thermally conductive element to function as a heat sink.

4. An electro-dynamic acoustic transducer system as claimed in claim 1, further comprising a vent through the rigid enclosure.

5. An electro-dynamic acoustic transducer system as claimed in claim 3, further comprising:

struts supporting the stator in the pressure compensated chamber from the rigid housing, the struts being thermally conductive for conducting heat from the magnetic circuit elements and from the voice coil to the rigid housing to be radiated to the environment.

6. An electro-dynamic acoustic transducer system as claimed in claim 1, further comprising:

the magnet assembly comprising first and second permanent magnets located with respect to one another to bring like poles into facing opposition; and the facing like poles being separated by a ferromagnetic focus element.

7. An electro-dynamic acoustic projector comprising:

a rigid enclosure having an open end;

a pressure compensated chamber extending into the rigid enclosure from the open end;

a vibratile piston located in the open end of the rigid enclosure and closing the pressure compensated chamber;

the vibratile piston has an anterior major surface exposed from the open end for generating sound waves in water;

a stator located in the pressure compensated chamber;

a stator coil located on the stator;

a magnet assembly attached to the vibratile piston to interacts with the stator coil;

the magnet assembly comprising first and second permanent magnets located with respect to one another to bring a pair of like poles into facing opposition;

a ferromagnetic focus element intermediate to the pair of like poles;

the pressure compensated chamber being filled with gas and having a variable volume allowing it to contract under increasing ambient pressure; and a valve into the pressure compensated chamber allowing the introduction and release of gas so that the volume of the pressure compensated chamber at a particular ambient pressure is known.

8. An electro-dynamic acoustic projector as claimed in claim 7, further comprising the pair of magnets being made of neodymium or samarium cobalt.

9. An electro-dynamic acoustic projector as claimed in claim 8, further comprising:

the stator including magnetic circuit elements arranged to define a gap into which the magnet assembly projects.

10. An electro-dynamic acoustic projector as claimed in claim 9, further comprising:

the rigid housing and vibratile piston being corrosion resistant for submergence in water;

the vibratile piston including means for the transfer of heat to the anterior major surface.

11. An electro-dynamic acoustic projector as claimed in claim 9, further comprising:

supports between the rigid housing and the stator providing for transfer of heat from the stator to the exterior of the rigid housing.

* * * * *